US005321999A

United States Patent [19]

Lin

[11] Patent Number: 5,321,999

[45] Date of Patent: Jun. 21, 1994

[54] AUTOMATIC INPACT SCREWDRIVER

[76] Inventor: Chang-Laang Lin, No. 61-1, Nan-Kuo Lane, Chang-Long Road, Tong-Ben Village, Tai-Ping Hsiang, Taichung, Taiwan

[21] Appl. No.: 103,062

[22] Filed: Aug. 5, 1993

[51] Int. Cl.[5] ..... B25B 19/00

[52] U.S. Cl. ..... 81/463; 173/121

[58] Field of Search ..... 81/463; 29/254, 275; 173/90, 121

[56] References Cited

U.S. PATENT DOCUMENTS 2,960,864 11/1960 Watts ..... 81/463 X

*Primary Examiner*—D. S. Meislin

*Attorney, Agent, or Firm*—Charles E. Baxley

[57] ABSTRACT

An automatic screwdriver is capable of generating an impact force on a screw that is being tightened or loosened. An action rod is disposed eccentrically in conjunction with a short helical spring. The eccentric position of the action rod is corrected by engagement with an annular flange within the main body of the handle upon rearward movement thereof which causes movement of the action rod into a slot in an impact rod resulting in an impact force which is imparted to a head tip.

3 Claims, 2 Drawing Sheets

AUTOMATIC INPACT SCREWDRIVER

FIELD OF THE INVENTION

The present invention relates generally to a hand tool, and more particularly to a screwdriver having a handle capable of generating therein an impact force at the time when the screwdriver is at work to turn a screw.

BACKGROUND OF THE INVENTION

A screwdriver is a handy and helpful tool for use in tightening or loosening a screw. The conventional screwdriver is generally made up of a handle and a shank having a head tip for turning a screw. Among several kinds of screwdrivers in existence today, the best-known screwdrivers include the screwdriver with a cross-shaped head tip for turning a Phillips screw that has two slots crossing at the center of the screw head, and the screwdriver with a slotted head tip that fits into the slot in the head of a slotted screw.

The prior art screwdrivers described above are generally defective in design in that they are often helpless and even useless in turning a screw which has been fastened excessively tight. It is therefore, a common practice that a hammer is used to strike the head tip of the screw at work. Such a maneuver works at times in view of the fact that the combined effects of the striking force of the hammer and the torsional force of the screwdriver work to cause the screw to turn. However, if an excessive force is used in an attempt to turn such a tightly fastened screw as described above, the slotted head of the screw is bound to be damaged severely. In addition, it often requires an utmost skill to loosen a tightly fastened screw with one hand holding the hammer used to strike the head tip of the screwdriver and with another hand holding the screwdriver in action.

SUMMARY OF THE INVENTION

It is therefore the primary objective of the present invention to provide a screwdriver with means capable of generating automatically an impact force which exerts on a screw that is being tightened or loosened.

The foregoing objective of the present invention is attained by an automatic impact screwdriver, which comprises mainly a hollow handle provided therein with a long helical spring, an impact rod, a short helical spring, an action rod, and a fitting rod. The screwdriver of the present invention is characterized in that the fitting rod has a front end extending beyond the front end of the handle so as to clamp a head tip of the screwdriver, and that the action rod is disposed eccentrically in conjunction with the short helical spring at the time when the screwdriver is not at work. However, the eccentric position of the action rod is corrected at the time when the screwdriver is in action so as to cause the fitting rod to urge the action rod to move backward, thereby causing the impact rod to exert an impact force on the action rod. Such impact force is then imparted to the fitting rod and then to the head tip of the screwdriver.

The foregoing objective, structures and functions of the present invention can be more readily understood upon a thoughtful deliberation of the following detailed description of the present invention in conjunction with the accompanying drawings.

DETAILED DESCRIPTION OF THE INVENTION

Figure 1:
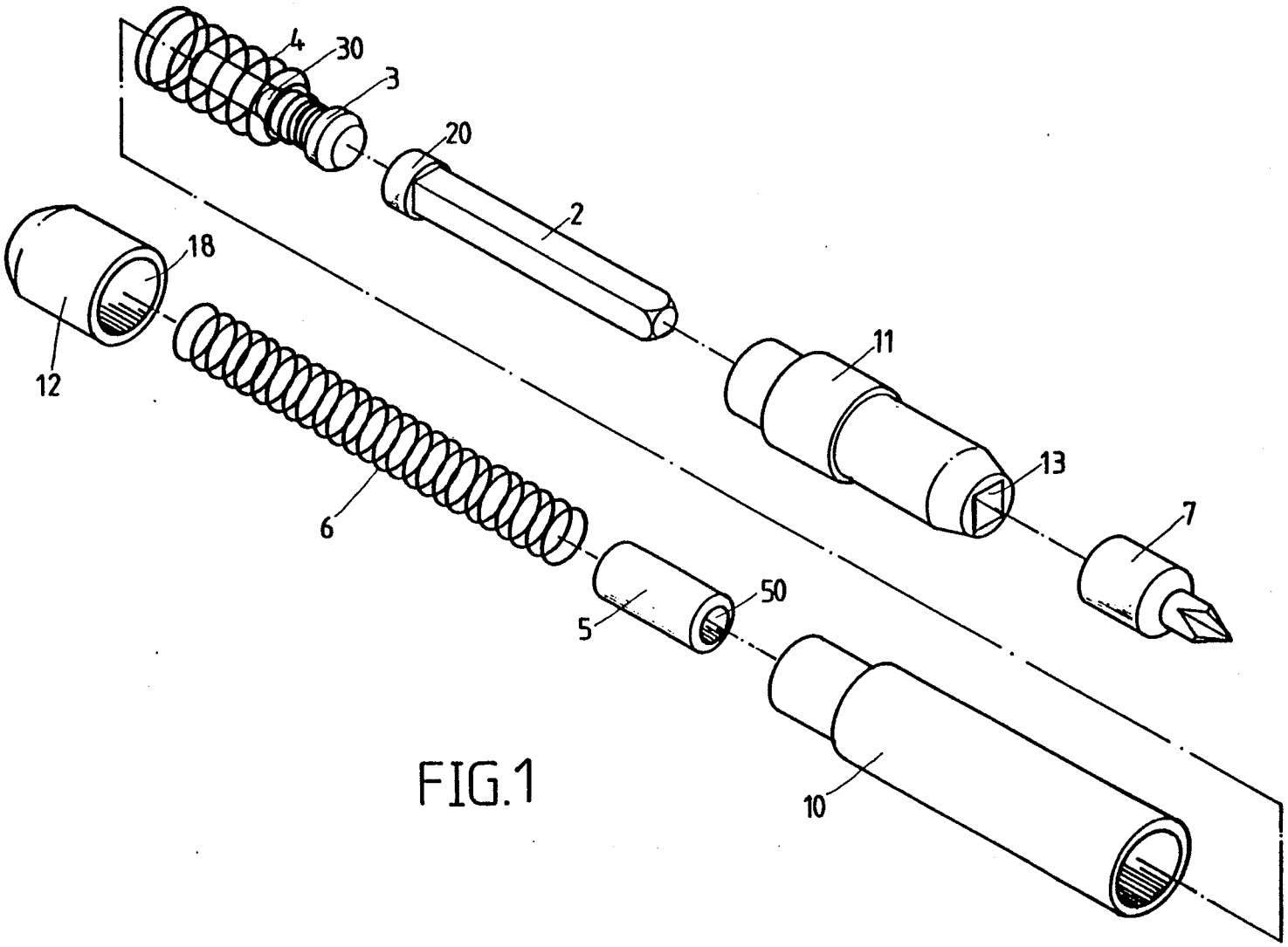
FIG. 1 shows an exploded view of the present invention.
Figure 2:
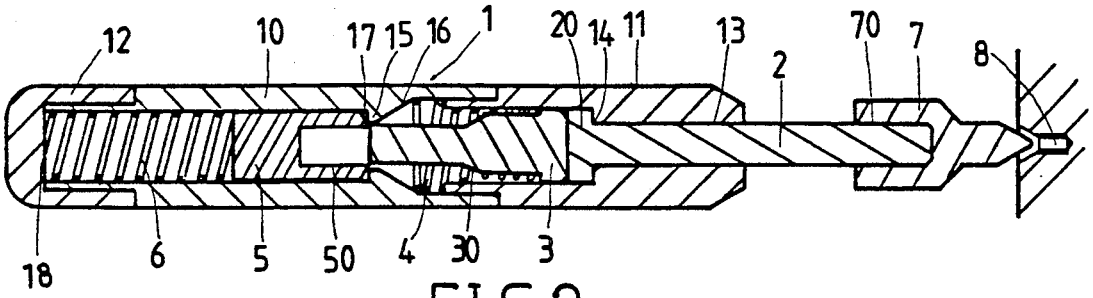
FIG. 2 shows a sectional view of the present invention in combination.

Referring to FIGS. 1 and 2, an automatic impact screwdriver of the present invention is shown to comprise a handle 1, a fitting rod 2, an action rod 3, a short helical spring 4, an impact rod 5, a long helical spring 6, and a head tip 7. The handle 1 is made up of a main body 10 of hollow construction and having a front end fitted into a front sleeve 11 and a rear end fitted into a rear sleeve 12. The long helical spring 6, the impact rod 5, the short helical spring 4, the action rod 3, and the fitting rod 2 are disposed in that order in the interior of the handle 1.

The front sleeve 11 is provided axially with a through tunnel 13, which has a smaller dimension in the front segment thereof and a larger dimension in the rear segment thereof and which has an arresting edge 14 located at the junction between the front segment thereof and the rear segment thereof. The hollow main body 10 is provided with an annular flange 15 which is disposed in the inner wall thereof and has a front end with a guide bevel 16 and a rear end with a vertical stopping edge 17. The rear sleeve 12 is centrally provided with a recess 18.

The fitting rod 2 is of slightly T-shaped construction and has a front end having a square cross section. The front end of the fitting rod 2 is so dimensioned as to fit into a socket 70 provided at the rear end of the head tip 7. The socket 70 of the head tip 7 also has a square cross section similar to that of the front end of the fitting rod 2. In addition, the fitting rod 2 is provided on the rear end thereof with a protruded ring 20 making the rear end of the fitting rod 2 greater in dimension than the front end of the fitting rod. The action rod 3 is so constructed that it is progressively smaller in diameter from its front end toward its rear end, and that it is provided with a guiding slant 30 located at the midpoint thereof. The action rod 3 has a rear end that is fitted into the short helical spring 4 of tapered construction. The impact rod 5 is of columnar construction and provided centrally at the front end thereof with a slot 50 corresponding in diameter to the rear end of the action rod 3.

In combination, the rear end of the long helical spring 6 is received in the recess 18 of the rear sleeve 12, while the front end of the rear sleeve 12 is fastened with the rear end of the main body 10 in such a manner that the front end of the long helical spring 6 urges the rear end of the impact rod 5. As a result, the front end of the impact rod 5 is pushed forward to press against the stopping edge 17 located at the rear end of the annular flange 15 of the main body 10. In the meantime, the action rod 3 and the short helical spring 4 can be disposed in the interior of the hollow main body 10 through the opening located at the front end of the main body 10, with the rear end of the short helical spring 4 urging the guide bevel 16 located at the front end of the annular flange 15 of the main body 10, and with the front end of the short helical spring 4 fitting over the rear end of the action rod 3. Therefore, the action rod 3 is so disposed in the main body 10 such that the action rod 3 is in an eccentric position at the time when the automatic impact screwdriver of the present invention is not in use. Moreover, the rear end of the action rod 3 is put through the center of the annular flange 15 of the main body 10 so as to press against one side of the front end of the impact rod 5. The fitting rod 2 is put into the through tunnel 13 of the front sleeve 11 via the rear end of the through tunnel 13 such that the front end of the fitting rod 2 emerges from the front end of the through tunnel 13 so as to fit into the socket 70 of the head tip 7, and that the protruded ring 20 of the fitting rod 2 is retained by the arresting edge 14 located in the through tunnel 13 so as to ensure that the fitting rod 2 does not become detached from the handle 1. The front end of the main body 10 is fastened with the rear end of the front sleeve 11 such that the rear end of the protruded ring 20 of the fitting rod 2 is in contact with the front end surface of the action rod 3.

Figure 3:
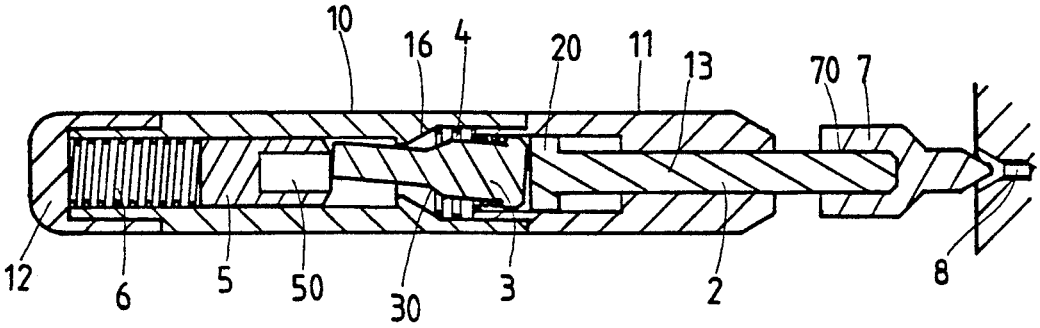
FIG. 3 shows a schematic view of the present invention in use.
Figure 4:
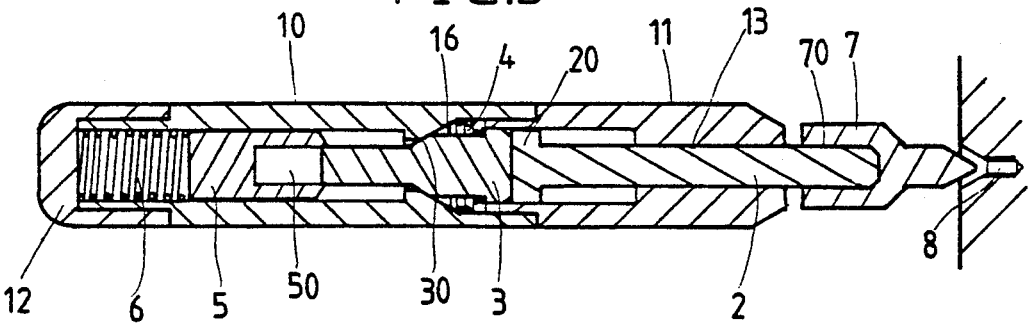
FIG. 4 shows another schematic view of the present invention at work.
Figure 5:
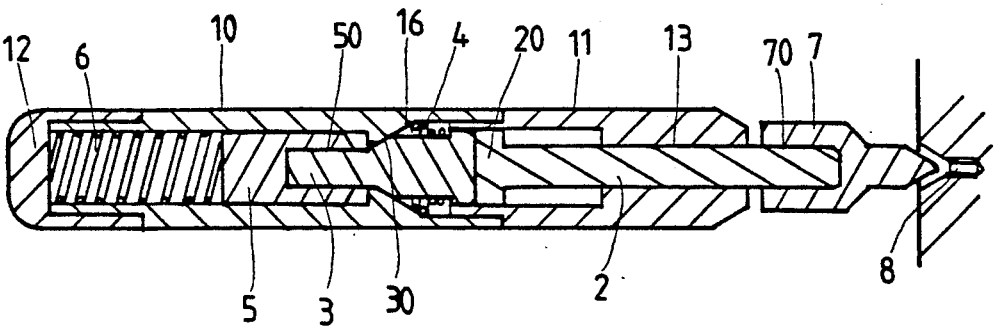
FIG. 5 shows still another schematic view of the present invention in action.

As illustrated in FIG. 3, the head tip 7 of the automatic impact screwdriver of the present invention exerts a pressure on a screw 8, thereby causing the fitting rod 2 to move rearward. As a result, the action rod 3 and the short helical spring 4 are forced to move rearward to exert a pressure on the impact rod 5 and the long helical spring 6. Now referring to FIG. 4, as the action rod 3 is forced by the fitting rod 2 to move rearward for an appropriate distance, the guiding slant 30 of the action rod 3 is caused to make contact with the guide bevel 16 of the annular flange 15 of the main body 10, thereby causing the eccentrically positioned action rod 3 to be so corrected as to be in a position that is parallel to the inner wall surface of the main body 10. In the meantime, the rear end of the action rod 3, which originally presses against only one side of the front end of the impact rod 5, is caused instantly to move into the slot 50 of the impact rod 5. As a result, the impact rod 5 is caused by the elastic force of the long helical spring 6 to move forward to cause the bottom wall of the slot 50 to exert a great deal of pressure on the rear end of the action rod 3, as shown in FIG. 5. The impact force of the impact rod 5 exerting on the action rod 3 is then imparted to the head tip 7 in contact with the screw 8. The action rod 3 can be again reoriented eccentrically by a light elastic force of the short helical spring 4 so that the automatic impact screwdriver of the present invention is once again ready to exert another round of impact force on the screw 8.

The embodiment of the present invention described above is to be regarded in all respects as merely illustrative and not restrictive. Accordingly, the present invention may be embodied in other specific forms without deviating from the spirit thereof. The present invention is therefore to be limited only by the scope of the following appended claims.

What is claimed is:

1. An automatic impact screwdriver comprising a handle of hollow construction and having a long helical spring, an impact rod, a short helical spring, an action rod, and a fitting rod, which are housed therein in that order, with said fitting rod having a front end extending beyond a front end of said handle to fit into a head tip; wherein said handle comprises a main body of hollow construction and having a front end fastened with a front sleeve and having a rear end fastened with a rear sleeve, said main body further having an annular flange disposed in an inner wall of a hollow interior thereof and provided on a front end thereof with a guide bevel and on a rear end thereof with a vertical stopping edge; wherein said fitting rod is of slightly T-shaped construction and provided on a rear end thereof with a protruded ring making said rear end greater in dimension than a front end of said fitting rod; wherein said action rod is fitted into said short helical spring and then disposed eccentrically in said hollow interior of said main body of said handle such that a front end of said action rod is in contact with said protruded ring of said fitting rod, and that a rear end of said action rod presses against one side of a front end of said impact rod, said action rod further comprising at a midpoint thereof a guiding slant; wherein said impact rod is of columnar construction and provided with a slot located centrally in a front end surface thereof and with a rear end urged by a front end of said long helical spring; and wherein said action rod can be caused to move rearward for a predetermined distance such that said guiding slant of said action rod makes contact with said guide bevel of said main body, and that said rear end of said action rod is shifted to fall into said slot of said impact rod, thereby causing said impact rod by said long helical spring to generate instantly an impact force, which is imparted to said action rod and then to said fitting rod.

2. The automatic impact screwdriver of claim 1 wherein said handle is composed of said main body, said front sleeve and said rear sleeve; wherein said front sleeve is provided axially with a through tunnel having a front segment, a rear segment and an arresting edge located between said front segment and said rear segment, with said front segment being smaller in dimension than said rear segment; wherein said main body has a hollow interior with an inner wall provided with an annular flange having a guide bevel located at a front end thereof and having a vertical stopping edge located at a rear end thereof; and wherein said rear sleeve is provide centrally at a front end thereof with a recess.

3. The automatic impact screwdriver of claim 1 wherein said front end of said fitting rod has a square cross section so dimensioned as to fit into a socket located at a rear end of said head tip; and wherein said protruded ring of said fitting rod is stopped by an arresting edge of said through tunnel of said front sleeve.

* * * * *